US005605481A

United States Patent [19]

Van Raden

[11] Patent Number: 5,605,481

[45] Date of Patent: Feb. 25, 1997

[54] LINE TENDING MARKER FLOAT

[76] Inventor: Charles Van Raden, 1701 N. 11th St., Moorhead, Minn. 56560

[21] Appl. No.: 637,130

[22] Filed: Apr. 24, 1996

[51] Int. Cl.[6] ..... B63B 22/18

[52] U.S. Cl. ..... 441/25; 441/26

[58] Field of Search ..... 441/1, 6, 21, 23, 441/24, 25, 26, 27

[56] References Cited

U.S. PATENT DOCUMENTS

| | | | |
|---|---|---|---|
| 1,993,974 | 3/1935 | McVicker | 441/26 |
| 2,649,019 | 7/1953 | Chetlan | 116/114 |
| 2,903,718 | 9/1959 | Wright, Jr. | 9/9 |
| 2,978,690 | 4/1961 | Kurie et al. | 441/26 |
| 3,002,490 | 10/1961 | Murray | 116/124 |
| 3,441,962 | 5/1969 | Williams | 441/25 |
| 3,461,835 | 8/1969 | Cockbill et al. | 116/124 |
| 3,597,778 | 8/1971 | Castelliz | 441/25 |
| 3,760,440 | 9/1973 | Casciano | 9/8 |
| 4,080,677 | 3/1978 | Koehler | 9/9 |
| 4,103,379 | 8/1978 | Wolfe | 9/8 |
| 4,114,561 | 9/1978 | Asaro | 116/124 |
| 4,475,476 | 10/1984 | Howard | 116/210 |
| 4,586,456 | 5/1986 | Forward | 116/210 |
| 5,231,952 | 8/1993 | Tenniswood | 116/210 |

*Primary Examiner*—Stephen Avila

*Attorney, Agent, or Firm*—Westman, Champlin & Kelly, P.A.

[57] ABSTRACT

A line tending device includes an anchor weight, and a hub that can be supported by a float. The hub has a clutch mechanism that controls the paying out or extension of a line for the anchor weight. The clutch includes an O-ring that will permit the line to extend in direction substantially vertically downward, substantially parallel to the axis of the hub that supports the O-ring, but which exerts a load on the line to tighten and effectively clamp the line against an edge of a flange and prevent the line from extending when the angle of the line relative to a hub axis exceeds a preselected amount.

15 Claims, 6 Drawing Sheets

LINE TENDING MARKER FLOAT

BACKGROUND OF THE INVENTION

The present invention relates to a marker float that has an anchor weight attached to an anchor line coiled onto a reel and having a line clutch that permits the anchor line to be payed out or unwound as long as the line extends substantially directly below the float device, but which stops the anchor line from unwinding when the float drifts sideways, so the angle of the anchor line changes from vertical.

In the past, various marker floats have been utilized for a wide variety of purposes including marking fishing spots, which is a prime objective, as well as providing a marker or buoy for indicating that a diver is below the surface. A problem exists where the marker anchor has a fixed length anchor line or a reel that will permit the anchor line to be extended, because the action of waves and wind will tend to move the marker float to a location that is other than directly above the anchor, which means the desired spot is no longer marked accurately.

These marker buoys may have floats that are fixed volume, or the markers can be compact units that have an inflatable balloon like device that will extend from the water surface and will float up, for example, when a diver is marking a spot from near the bottom of the body of water.

Various devices have been advanced in an attempt to overcome the drift problem of a floating marker. For example, in U.S. Pat. No. 4,103,379 a marker buoy is shown with an inflatable body, and a central core that forms a reel for a line attached to an anchor weight. The unit includes flexible finger elements that allow the anchor line to unwind off the hub while an anchor weight drops to the bottom. It is stated that the flexible fingers will prevent further unwinding of the anchor line, but this is only effective after the line is manually clipped in place. If manually clipped the anchor line will not extend from wave or wind action.

U.S. Pat. No. 3,760,440 shows a diver signal and/or marker that includes a flexible inflatable bag that will rise to the surface when desired to mark the position of a diver.

U.S. Pat. No. 5,231,952 also shows a stowable, inflatable marker for marking underwater locations, utilizing a weight and an anchor line.

Other similar devices are known, but none include a compact line clutch that is sensitive to the angle of the anchor line relative to the float, to automatically prevent unwanted extension of the line. The anchor line clutch of the present invention can be used with an inflatable marker as shown, or with a float such as a plastic bottle that can be attached to the end of the clutch and line reel mechanism for operation.

SUMMARY OF THE INVENTION

The present invention relates to a marker buoy anchor line tending clutch that controls the amount of line that unreels, particularly in rough water conditions, so that the marker, which comprises a floating member, remains directly above the marked location.

The line tending clutch of the present invention can be utilized with an inflatable float for the marker. In one form of the invention, the float is self storing inside a housing for the line tending apparatus, or can be coupled to a preformed float, such as a plastic bottle, merely by screwing the line reel, clutch, and anchor weight assembly onto the bottle.

The inflatable bag float is easily operated by a diver for marking a spot from below the surface, or from the surface by a fisher person that would be in a boat and wanted to mark a hot fishing spot. The inflatable bag forming the float in the compact unit is easily inflated by blowing through a check valve. The anchor weight mounts onto a main housing so that the unit is very compact when the inflatable bag is stored. The anchor weight is mounted with a ratchet arrangement so that rotation of the weight on a hub will tighten the line onto the reel when being stored. The line is thus tightly held on the reel and does not tend to snag or become entangled, nor will it unwind.

The anchor line passes from the reel to a line feed clutch region which comprises a center clutch hub or drum and end flanges that extend outwardly from the hub a selected amount. The line is placed underneath an elastomeric ring, commonly called an "O" ring, which surrounds the hub, and which can move up and down on the clutch hub between the flanges. When the line is being removed from the reel and extending substantially straight down from the marker float, the line will uncoil around the reel as the line moves around the surface of the clutch hub under the O-ring, because the selected tension of the O-ring is not sufficient to clamp the line. The O-ring can easily stretch and assumes a position where it does not act to "snub" the line against one end flange of the clutch hub.

However, when the float starts to drift off the vertical alignment, the line forms an angle from the axis of the float. When the angle is in the range of 15° or so, the line will force the clutch O-ring to move upwardly toward the upper flange on the clutch hub and the angle of the line as it bends around the upper flange causes the O-ring to act to "snub" the line and prevent it from coming off the reel. The line reel is immediately above this flange.

In other words, the angle of the line will cause the O-ring to move up toward the flange at the top of the clutch (adjacent one end of the reel) to where the O-ring exerts enough force to clamp the line and prevent further pay out under normal wind loading or wave loading of a float forming the marker. The action will effectively maintain the length of line between the weight or anchor and the clutch to cause the float to remain substantially directly above the weight at all times. Any action tending to move the float along the water surface, such as wind or waves, will merely cause the float to bob around as it is held in its desired position.

DETAILED DESCRIPTION OF THE PREFERRED EMBODIMENTS

Figure 1:
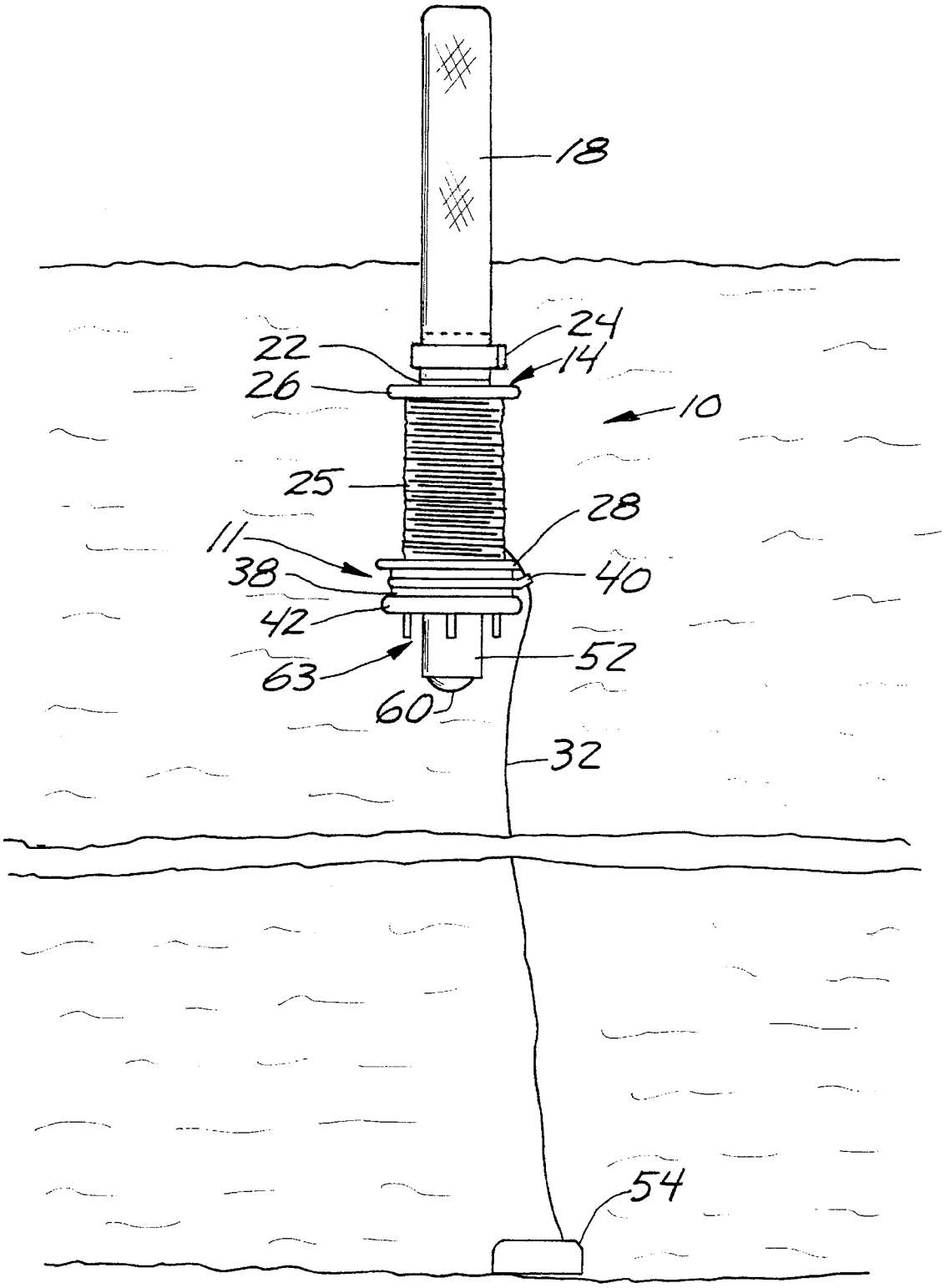
FIG. 1 is a schematic representation of a line tending marker float made according to the present invention utilizing an inflatable float.
Figure 2:
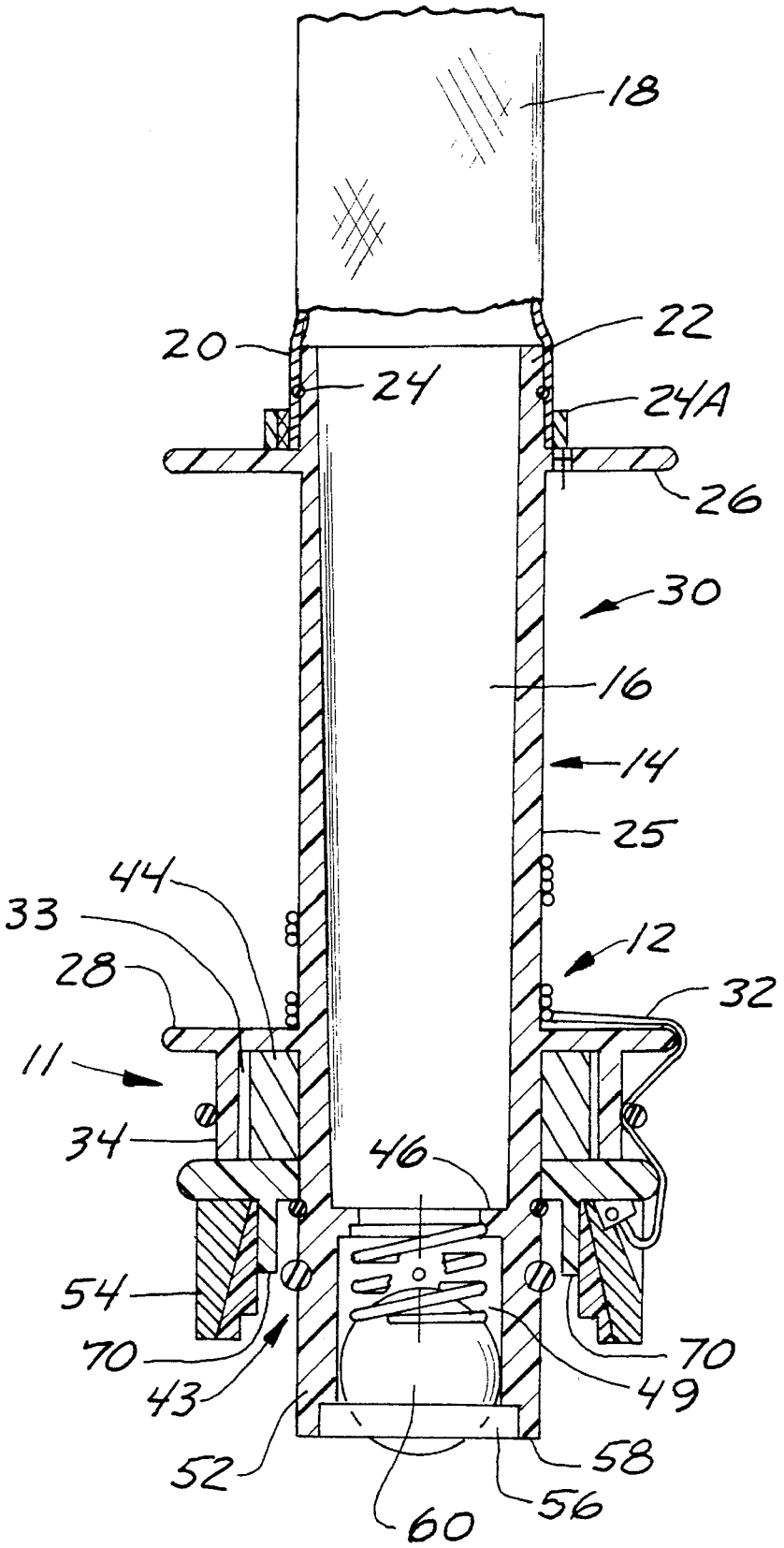
FIG. 2 is a sectional view of the float of FIG. 1 including a line clutch assembly.
Figure 4:
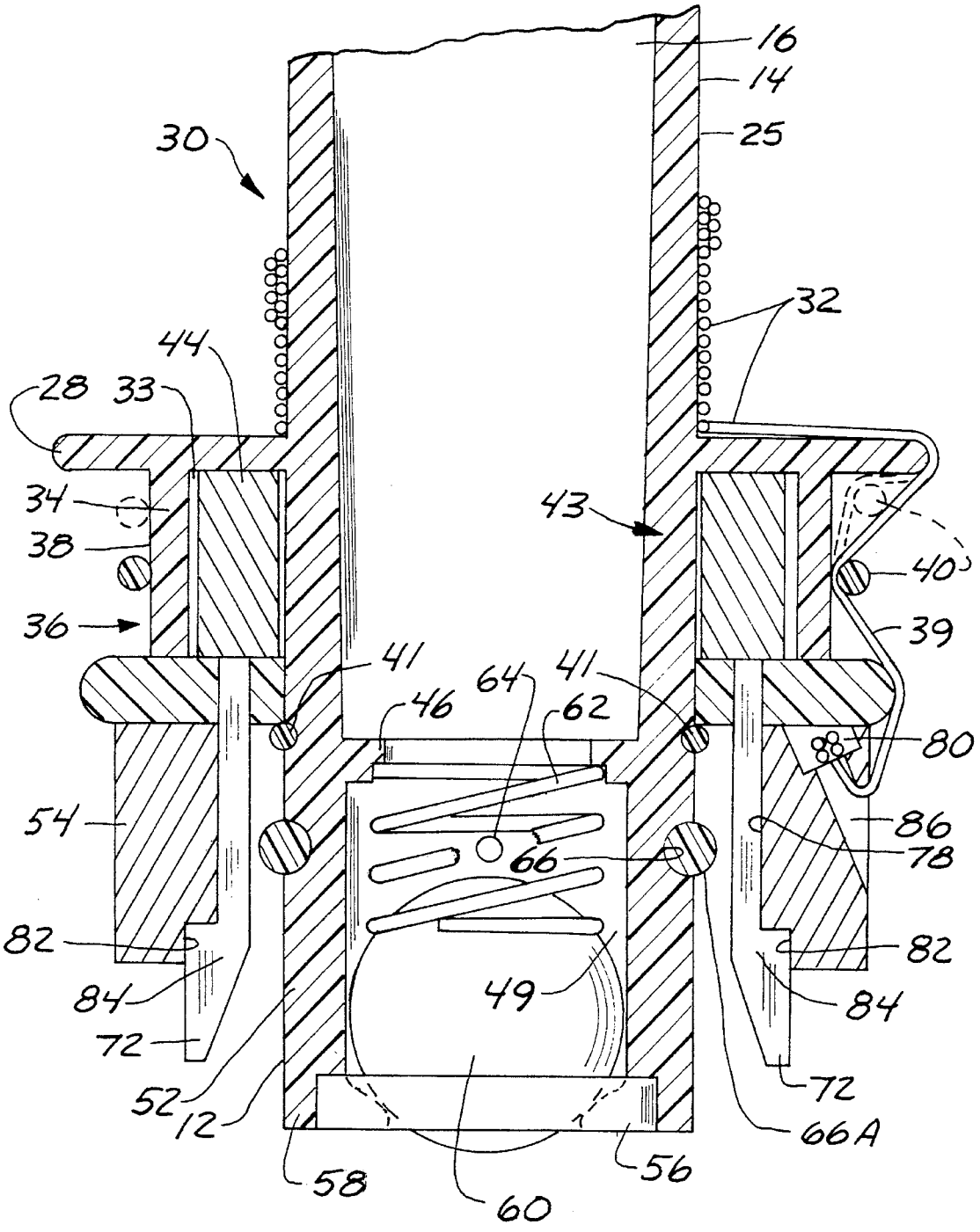
FIG. 4 is a sectional view taken as on line 4—4 in FIG. 3.
Figure 5:
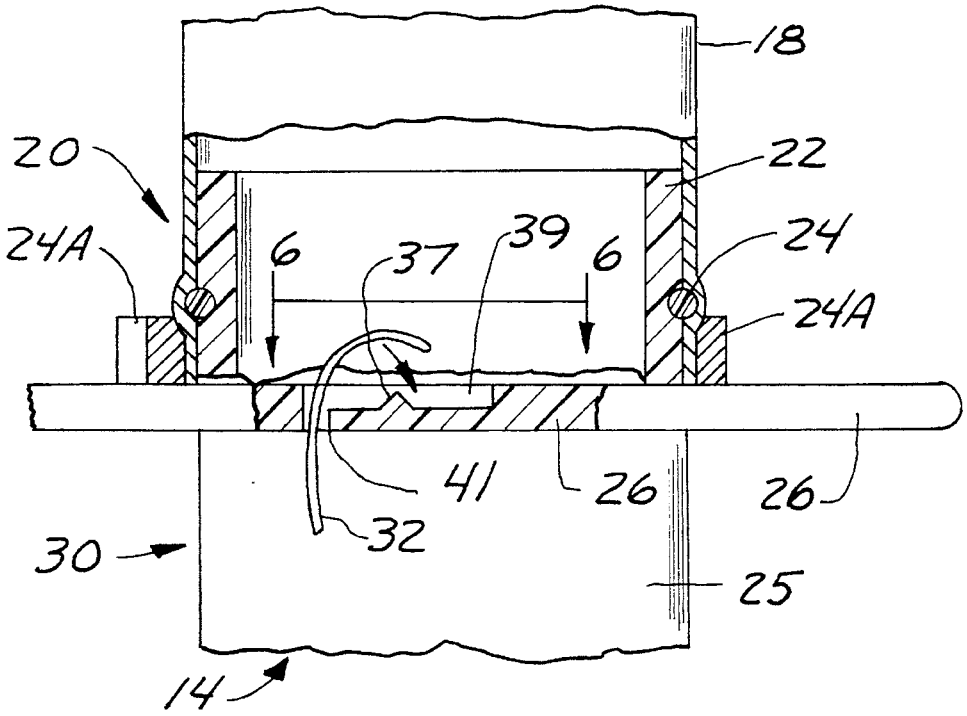
FIG. 5 is a fragmentary enlarged view of the float end of the marker of FIG. 2, with parts broken away.

Referring to FIG. 1, a marker float indicated generally at 10 includes an anchor line tending device 11 made according to the present invention. As shown in FIGS. 1, 2 and 4 the line tending device 11 comprises a support housing or frame 12 that has a cylindrical tubular section 14 having an interior passageway 16. An airtight, inflatable float bag 18 has its open end 20 mounted over a neck 22 of the cylindrical portion 14. The interior of bag 18 is sealed air tight relative to the outer surface of the neck 22 as shown in FIG. 5 through the use of an O-ring 24 which surrounds the neck 22. The end 20 of the bag 18 is slipped over the O-ring 24 and a suitable, well-known band clamp 24A is clamped around the bag end 20 to hold it onto the neck 22. This makes the interior of the float bag, which can be a rubberized fabric or other suitable material, open to the passageway 16 on the interior of the cylindrical portion 14.

The housing 12 has a line reel section 30 formed with a hub portion 25 positioned between two annular flanges 26 and 28 that are spaced along the cylindrical member 14 to form the line reel section 30 on which a suitable anchor line or cord 32 can be wrapped. The cord 32 is wound around the hub portion 25 in a normal manner, and an attempt is made to have it "level wound" so that it will not snarl as it is unfurled or unwrapped.

The cylindrical portion 14 includes an annular wall 34 near the lower end (FIG. 4) that is below and integral with flange 28. Wall 34 is spaced from the wall of cylindrical section 14 to form an annular space 33. The wall 34 also forms an anchor line clutch hub 36. The clutch hub 36 has a clutch hub surface 38 that is positioned between the underside of reel flange 28, and a second clutch flange 42, that has a center opening to permit it to be slid over the outer surface of the base end 43 of housing 12. The flange 42 is held against the end of wall 34 with a retainer ring 41. The flange 42 is thus securely held in place. The retainer ring 41 could be a metal snap ring, or an O-ring. The flange 42 is smaller in diameter than flange 28 and rounded more so the line 32 slides over and along the edge of flange 42 easily unless the clutch operates to snub the line, as will be explained. The line 32 travels around the edge of both clutch flanges 28 and 42 as it unreels or pays out. The line passes under an O-ring 40 that fits over the clutch hub surface 38 and is of strength to provide a drag on the line 32 and provide the clutch action.

Figure 6:
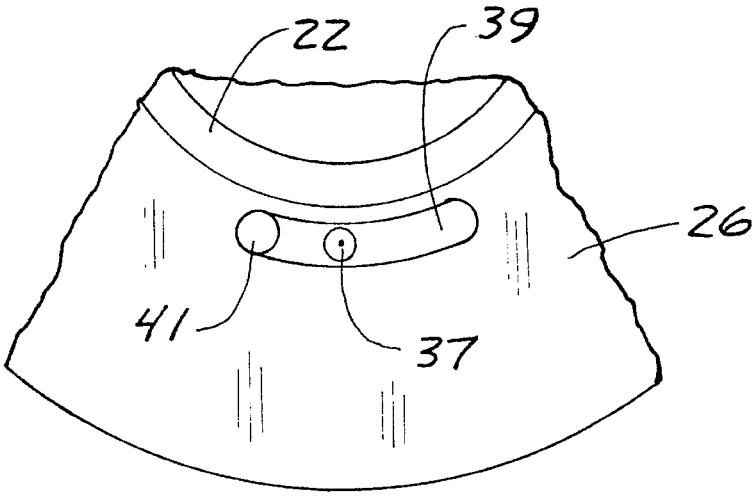
FIG. 6 is a fragmentary plan view taken on line 6—6 in FIG. 5.

As shown in FIGS. 5 and 6, one end of line 32 can be held on the line real using a retaining pin or prong 37 in a recess 39 formed on the top of flange 26. The line 32 is passed up through a hole 41 in flange 26 from the line reel and then pushed onto prong 37 to retain it in place. Other line securing devices can be used.

The annular space 33 between wall 34 and the outer surface of the lower portion 43 of cylindrical portion 14 of the housing 12 contains a ring, like lead ballast or counterweight 44. The counterweight 44 is put into the opening 33 before the flange 42 is assembled onto housing 12. The counterweight 44 is held in place when the flange 42 is mounted and held with retaining ring 41.

The lower portion 43 has an internal ring type wall 46 dividing the cylindrical portion 14 from a lower check valve neck 52. In storage position the neck 52 is surrounded by a ring like anchor weight 54. The lower end of the interior bore 49 of neck 52 has a suitable seal 56, such as a shaft oil seal, to provide a seat for a check valve ball 60. The seal 56 is held in a recess on the interior of the bore portion 49. Check valve ball 60 is mounted in the bore 49 and is urged toward the seal 56 with a spring 62 that is supported on wall 46 and exerts a spring load tending to seat ball 60 on seal 56.

The neck 52 is also provided with a pressure relief valve arrangement for the bore portion 49 and the passage 16. The pressure relief valve arrangement includes one or more pressure relief bores 64 in the wall of neck 52 through the bottom of an exterior O-ring groove 66 seating an O-ring 66A. Ports 64 open to the bore 49. There are preferably three bores 64, and two are shown in FIG. 4. The O-ring 66A serves as a relief valve, so that if the pressure in the bore 16 or 49 becomes excessive, the elastic O-ring 66A will move outwardly slightly from the bottom surface of the groove 66 and will then permit air under pressure inside the bore 49 to be relieved outwardly. This over pressure relief valve acts so that if the air pressure in the inflatable bag 18 becomes excessive, pressure will be relieved even though the ball 60 remains seated on the seal 56.

Figure 3:
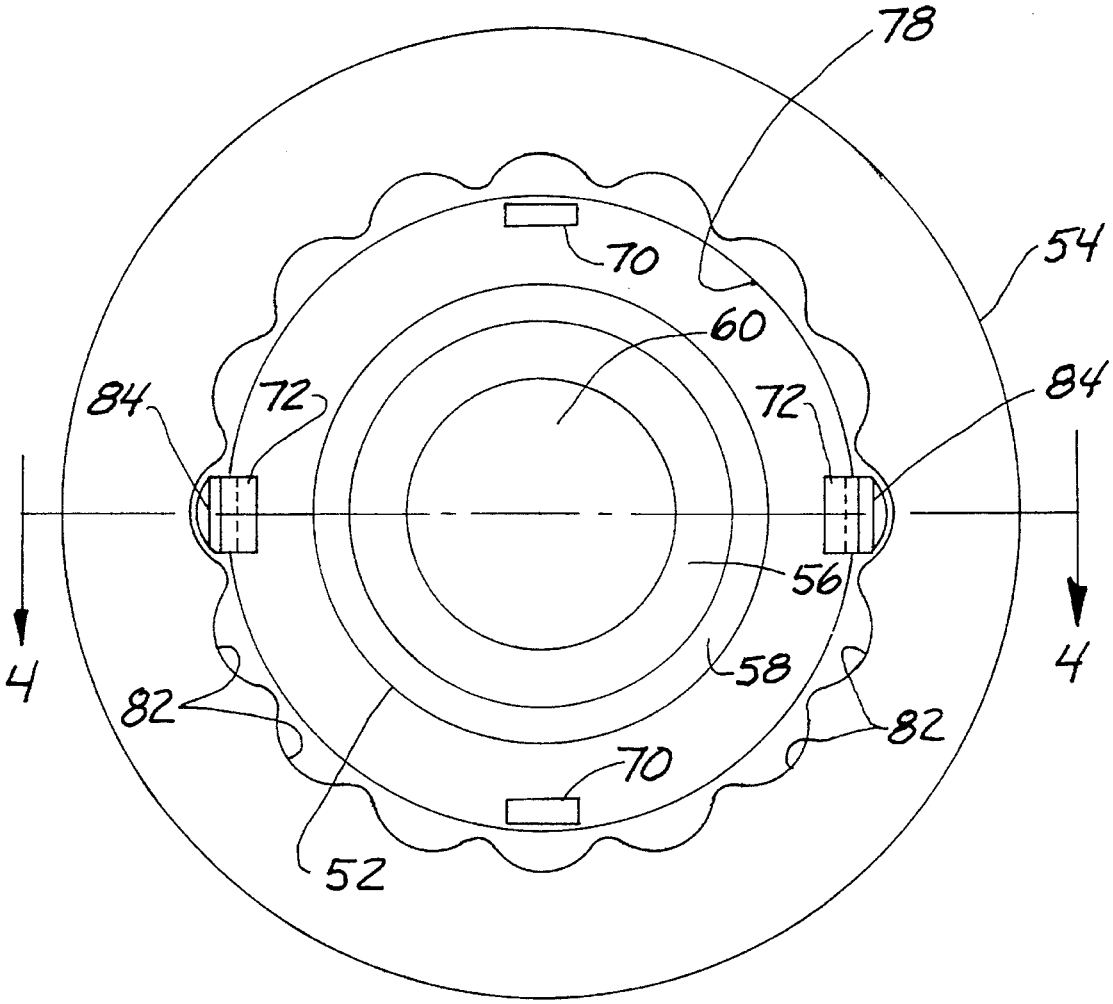
FIG. 3 is a sectional view of a typical weight and line windup mechanism utilized with the present invention.

The flange 42 has, as can be seen in FIGS. 2 and 3, a pair of downwardly depending guide members 70 on opposite sides of the neck 52, and as shown in FIGS. 3 and 4, a pair of spring loaded latch detents or latch fingers 72 on opposite sides of the neck 52, which are offset 90° from the guide members 70. The guide members 70 and spring latch fingers 72 can be made of selected plastic material and epoxied or otherwise secured in place on flange 42. The guides and fingers guide the ring like anchor weight 54. The anchor weight 54 can be a block of lead that has a central bore 78 of size to fit around the guide fingers 70 and the detent fingers 72.

The lower end of the bore 78 has a series of inwardly facing detent notches 82 around the periphery, and the notches 82 receive lugs 84 formed at the end of the spring detent fingers 72. When the lugs 84 are within aligned notches 82, the anchor weight 54 is held against the underside of the flange 42 and is also restrained from rotation on the guides 70 and shank portions of the spring detent fingers 72 relative to the flanges. However, because the spring detent fingers 72 are made "springy", manual rotation of the anchor weight will cause the fingers 72 to "click" into the recesses 82 as the weight rotates. This permits rotating the anchor weight 54 on the guide members 70 and spring detent fingers 72 for tightening the anchor line 32 around the reel hub 25 as will be explained.

As shown in FIG. 4, the anchor weight 54 has an angled bore 86 through the sidewall and opening to the upper surface of the anchor weight. The anchor line 32 passes through this bore 86 and can be knotted in an enlarged countersunk portion 80 so that it will be retained in the enlarged countersunk portion 80 of the bore 86. The anchor line 32 is thus securely held on the counter weight. The line 32 will be wound on the line reel hub 25 as previously mentioned. The cord 32 can be any desired length as needed. As shown in the assembly of FIG. 2 the anchor weight 54 will be secured on the flange 42 and held by the guide members 70 and spring detent or latch fingers 72.

The anchor weight 54 can be removed from the housing 12 by grasping the outer ends of the spring detent fingers 72 and moving them inwardly so that they clear the inner bore 78 of the anchor weight. Then the anchor weight 54 can be removed. This will permit the anchor line 32 to be dragged downwardly as it unwinds or unwraps and moves around the edge of the flange 28 around the clutch hub 36. The line will unwind from the cord reel hub section 25 as the line moves around the edge of the flange 28 and moves around surface 38 under O-ring 40, until the anchor weight 54 strikes the bottom of the body of water, assuming that the float device has been inflated or is separately attached, if preinflated.

The line 32 can be retrieved and wound manually onto the line reel 25, until there is only a short length of cord left free, sufficient to permit the anchor weight 54 to be fitted over the outer end of the neck 52 and slid into place on the spring detent fingers 72 and the guides 70. The anchor weight is held on under the surface of the flange 42. Then the anchor weight can be rotated about a central axis as guided by the guides 70 and spring fingers 72, as the ends 84 of the spring fingers 72 click in and out the detent recesses 82. The anchor weight 54 will be rotated in the proper direction to further tighten the line 32 on the reel, until the line 32 is held securely and tightly on the reel, with no slack. The spring detent fingers 72 will hold the anchor weight 54 in this rotational position with the line 32 taut and properly secured.

In a "stored" and deflated position, the inflatable float bag 18 will be deflated and stuffed inside the bore 16, but will be held sealed at its open end by the clamps 24A on the neck 22. The user then will have a very compact float and marker assembly that can be retrieved from its storage location, such as on a diver's belt, or a tackle box if used by the people that are fishing, and the bag 18 can be inflated by merely placing the neck 52 gently against your lips to unseat the ball 60 and blowing causing air to inflate the float bag 18. The bag 18 will be pushed out of the bore 16 into its erected position as shown in FIG. 1. Oral inflation will provide the desired amount of pressure as regulated by the operator and the relief valve O-ring 66A. The anchor weight 54 can then be removed from the housing 12 by manually inwardly retracting the outer ends of the spring fingers 72, and pulling the anchor weight off the spring fingers 72 and the guides 70.

Once clear of the spring fingers 72, the anchor weight 54 and the floatation device, with the float bag 18 inflated, can be thrown overboard or released by a diver. The float bag 18 will act as a float for the housing 12 with the bag 18 upright as shown in FIG. 1. The anchor weight will pull on the cord 32 to unwind it from the cord reel hub as the anchor weight drops straight downwardly from the float as shown in FIG. 1. Once the anchor weight 54 hits the bottom of the body of water, the floating housing will be anchored in place and the O-ring clutch will act to keep excess line 32 from paying out or unreeling from the line real hub. As soon as the float drifts off from a substantial vertical position only a few degrees, the O-ring 40 will stretch and expand due to increased load on the line 32. The O-ring 40 also will roll toward flange 28 tending to cause the line to be snubbed against the edge of the flange 28 as illustrated in FIG. 2. The O-ring 40 is selected to provide increasing load as it expands, as most elastomeric materials do, and this, coupled with the fact that the O-ring moves upward toward the flange 28, will cause the holding action for the line 32 to prevent the line from unwinding more. The snubbing of the line 32 will maintain the line length substantially constant so the float bag and float housing 12, stay substantially vertically over the desired marked area.

Figure 7:
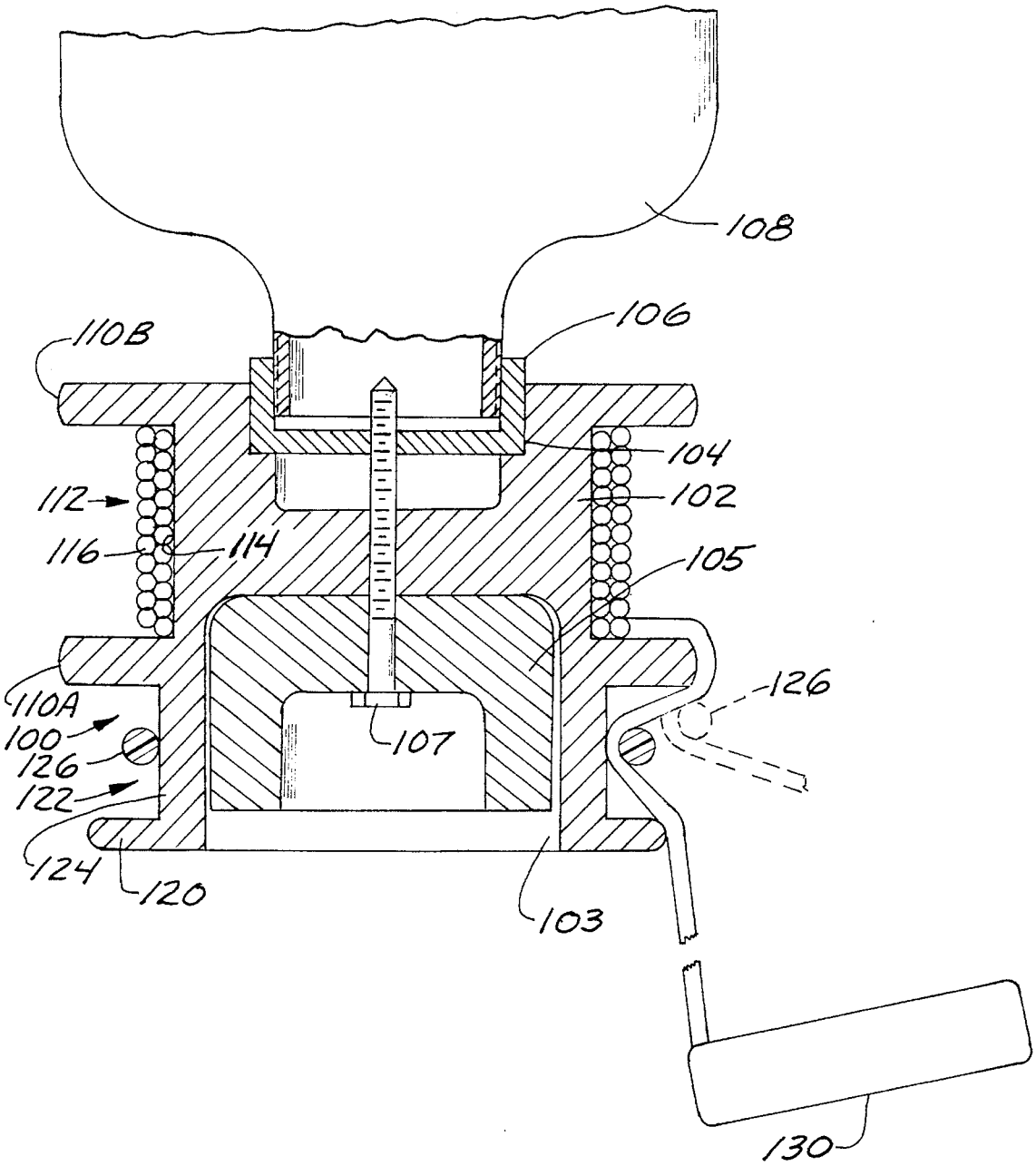
FIG. 7 is a sectional view of a modified form of the line tender of the present invention illustrated in place on a permanent float comprising a plastic jug threaded into place.

A modified form of the invention is shown fragmentarily in FIG. 7 in cross section, and illustrates the use of a fixed float utilizing an anchor line clutch hub assembly substantially identical to that shown at 36 in the previous form of the invention. In this form of the invention, an anchor line clutch hub assembly indicated generally at 100 has a hub body 102, with a recess 104 at the upper end. A bottle cap 106 for a plastic jug 108 fits in place in this recess. The cap can be merely put on the outside surface of the body.

The body 102 has a large recess 103 on the lower side, which receives a ballast or counter weight 105 of suitable size. A screw 107 passes through a bore in the base end of counter weight 105 and is threaded through a portion of the body 102 so the end of the screw protrudes far enough to pierce and threadably hold the bottle cap 106 in place. The threads on screw 107 are deep enough to hold tile cap.

An empty plastic jug or bottle 108, such as a water bottle or other screw cap bottle, can then be inverted and pushed or screwed in place on the cap 106. As shown the jug 108 forms a float that is of a fixed size and does not need inflation.

The hub 102 has a pair of spaced apart flanges 110A and 110B that form a cord reel 112, having a reel hub surface 114 on which an anchor line 116 is wound.

As schematically shown, a flange 120 is used for part of a line clutch 122. The clutch assembly 122 has a hub surface 124 that is surrounded by an O-ring 126, which is positioned between the lower line reel flange 110A and the flange 120. The anchor line 116 is passed under the O-ring 126, as in the previous form of the invention, and is secured to a lead anchor weight 130. This lead anchor weight 130 can be formed as a narrow elongated band, and since lead is malleable, it can be wrapped around the clutch hub, or wrapped around the line reel after the line is manually reeled into place, to hold the line securely in place. The length of the strap weight 130 is selected so that it will lock around the cylindrical hub in a suitable location. The weight 130 is sufficiently heavy so that it will cause the cord to be unreeled by unwinding around hub 110A and moving under the O-ring 126 so long as the cord is extending substantially vertically downwardly. Once the weight 130 hits the bottom of the body of the water, it will anchor the float jug 108 and the hub.

If the anchor line 116 goes off at an angle, as illustrated in dotted lines in FIG. 7, the O-ring 126 will extend, and roll toward flange 110A and will cause a "snubbing" action on the outer edge of the lower flange 110A to secure the anchor line 116 from further extension. In this way it is insured that the float will not be moved by winds or waves to a position other than a few degrees from a position vertically above the weight 130.

The weight 130 can be held in place on the line reel in the same manner as shown in the first form of the invention, if desired, but for convenience in making the size small and easily stored in a tackle box, using a strap weight that merely wraps around the line reel when the line 116 has been tightly wound is satisfactory.

Of course, other types of clamps for holding the line can be used as well, once the line has been fully rewound. The size (both the diameter of the ring and diameter of the cross section of rubber) the O-ring 126 may be varied, as well as the diameter of the 0ring, depending on the size and stiffness of the line 32 or 116 and other factors, such as the size of the flange over which the line extends before it passes under the O-ring. The size of the float, which determines the lateral forces tending to move the float on the surface from a vertical position also is a factor in the O-ring size.

In one example, utilizing a 3/32 inch diameter polypropylene line, and a clutch hub that had an outer diameter of 2.5 inches together with a flange against which the line was snubbed that had an outer diameter of 3.25 inches and a number 141 O-ring of 50 durometer, made by Precision Associates was used. This arrangement provided good results for maintaining a small diameter (2 inches or so) float above the weight, when the float was an inflatable bag type float as shown in the first form of the invention. The size of the line has the most influence on the O-ring needed for a clutch.

It is apparent that this type of a clutch can be adapted to any desired type of float merely by making a suitable coupling between the float and the clutch, and it is not necessary that the inflating valve arrangement be utilized, if a previously inflated float is to be attached. The line tending unit therefore fulfills a need for a low cost type of clutch that will permit the line to unwind until a bottom of the body of water is reached, but will retain the line, thereafter, automatically against lateral movement caused by waves, wind or other facts.

This makes a very efficient, easily used marker device for people that need to mark locations in a body of water, or to mark locations of a guide reel.

Although the present invention has been described with reference to preferred embodiments, workers skilled in the art will recognize that changes may be made in form and detail without departing from the spirit and scope of the invention.

What is claimed is:

1. A line tending device for a flotation marker unit including a base, a clutch hub on the base, a source of a line that will extend in response to a weight thereon, said clutch hub having a clutch hub outer surface and upper and lower flanges, and an elastomeric O-ring surrounding the hub outer surface between the upper and lower flanges, said line passing over an outer edge of the upper flange, and inwardly to the clutch hub between the hub outer surface and the O-ring, and extending out from the hub outer surface around an outer edge of the lower flange, an anchor weight on an end of the line of sufficient weight to cause the line to extend and move between the O-ring and the hub outer surface when the line is substantially vertically below the outer edge of the lower flange, the O-ring providing a tension on the line to tend to provide a clamping action on the line around the upper flange that increases as the line angle relative to a central axis of the hub and the weight increases.

2. The device of claim 1 including a float for maintaining the hub axis in a generally upright position with the lower flange oriented substantially horizontally and the hub axis oriented substantially vertically while the hub is floated relative to the surface of the body of water.

3. The device of claim 2, wherein the source of line comprises line reel portion on the base, including a third flange spaced above the upper flange, the line being wound around a reel hub between the upper flange and the third flange, and extending around an outer edge of the upper flange to pass under the O-ring.

4. The device of claim 1 including a coupling for attaching a preinflated float to the hub at an end thereof opposite from the lower flange.

5. The device of claim 1 including an inflatable float mounted on said hub, said inflatable float being coupled to the base and having an air inlet valve for inflating the float.

6. The device of claim 1 and an anchor weight removably mounted on the base and connected to the line, said anchor weight being a ring weight and supported on the hub with releasable spring loaded fingers.

7. The device of claim 6, wherein said anchor weight has an inner opening and a plurality of notches on an edge of the inner opening, and spring fingers mounted on the hub to engage the notches and retain the counter weight at rotational locations by interengagement of the spring fingers and the notches, said spring fingers yielding to permit the anchor weight to be rotated about the hub to tighten a line around a periphery of the hub when the anchor weight is supported on the fingers.

8. The device of claim 5, wherein the base includes a cylindrical extension coupled to the hub and having one open end, said float being a flexible bag open to the open end and insertable into the open end for storage in the cylindrical extension.

9. The device of claim 8, wherein the base has a bore at a lower end thereof communicating with an interior passage of the cylindrical extension, and a check valve inlet to the bore at a lower end thereof capable of being operated by mouth for blowing air through the check valve to inflate the float.

10. A line tending device for a flotation marker unit including a base, a clutch hub on the base, adjacent one end thereof, the base being floatable with the one end forming a lower end, a line reel formed on the base above the clutch hub and having a line thereon that will unwind in response to a weight thereon, said clutch hub having a clutch hub outer surface and upper and lower flanges, the upper flange forming a flange for the line reel around which the line will unwind from a reel hub, and an elastomeric ring surrounding the hub outer surface between the upper and lower flanges, said line passing over an outer edge of the upper flange and inwardly to the clutch hub between the hub outer surface and the elastomeric ring, and extending out from the hub outer surface around an outer edge of the lower flange, an anchor weight on an end of the line of sufficient weight to cause the line to extend and move between the elastomeric ring and the hub outer surface to unwind from the reel hub and move around the edge of the upper flange when the line is substantially vertically below the outer edge of the lower flange, the elastomeric ring providing a tension to force the line toward the hub outer surface and around the upper flange, and as the line angle relative to a central axis of the hub and the weight increases the elastomeric ring being operable to snub the line around the edge of the upper flange.

11. The device of claim 10 including a float for floating the hub and a ballast for maintaining the hub axis in a generally upright position with the lower flange oriented substantially horizontally and the hub axis oriented substantially vertically while the hub is floated relative to the surface of the body of water.

12. The device of claim 10, wherein the lower flange is of smaller diameter than the upper flange, the lower flange having a radiused outer surface on which the line moves as it unwinds.

13. The device of claim 10 including a coupling for attaching a preinflated float to the hub at an end thereof opposite from the lower flange.

14. The device of claim 10 including an inflatable float mounted on said hub, said inflatable float being coupled to the base and having an air inlet valve for inflating the float.

15. The devices of claim 14, wherein the base has a bore with an upper and lower end, and the inlet valve comprises a check valve operable by blowing on the lower end to cause the float to inflate.

* * * * *